US011213076B1

(12) United States Patent
Bueneman

(10) Patent No.: US 11,213,076 B1
(45) Date of Patent: Jan. 4, 2022

(54) COLLAR SUPPORT SYSTEM

(71) Applicant: Walter Thomas Bueneman, Dunedin, FL (US)

(72) Inventor: Walter Thomas Bueneman, Dunedin, FL (US)

( * ) Notice: Subject to any disclaimer, the term of this patent is extended or adjusted under 35 U.S.C. 154(b) by 0 days.

(21) Appl. No.: 17/125,141

(22) Filed: Dec. 17, 2020

Related U.S. Application Data

(60) Provisional application No. 62/949,077, filed on Dec. 17, 2019.

(51) Int. Cl.
*A41B 3/06* (2006.01)

(52) U.S. Cl.
CPC ..... *A41B 3/06* (2013.01)

(58) Field of Classification Search
CPC .... A41B 3/06; A41B 3/08; A41B 3/18; A41B 7/08; A41D 27/16; G09F 21/023
USPC ..... 2/132, 134
See application file for complete search history.

(56) References Cited

U.S. PATENT DOCUMENTS 440,027 A * 11/1890 Gibble ..... A41B 3/06 2/132
443,023 A * 12/1890 Weir ..... A41B 3/06 2/132
892,604 A * 7/1908 Meehan ..... A41B 3/06 2/132
D44,319 S * 7/1913 Murphy ..... D2/609
2,475,931 A * 7/1949 Wimmer ..... A41B 3/12 2/138
2,515,802 A * 7/1950 Sato ..... A41B 3/06 2/132
2,633,576 A * 4/1953 Powers ..... A41D 27/16 2/60
2,724,836 A * 11/1955 Wiedemer ..... A41B 3/12 2/132
3,072,306 A * 1/1963 Macrides ..... B65D 85/182 223/84
3,318,498 A * 5/1967 Yonglove ..... B65D 85/182 223/83
4,133,463 A * 1/1979 Bourrian ..... B65D 85/182 223/83
6,889,387 B1 * 5/2005 Tiss ..... B65D 85/182 2/132
8,065,746 B2 * 11/2011 Keeter ..... B65D 85/182 2/129
2002/0106481 A1 * 8/2002 Lin ..... B32B 5/04 428/102
2008/0134410 A1 * 6/2008 Eisenberg ..... A41B 3/06 2/132
2010/0313331 A1 * 12/2010 English ..... A41B 3/06 2/132
2011/0079225 A1 * 4/2011 Vole ..... A61M 15/085 128/206.24
2011/0113526 A1 * 5/2011 Harris ..... A41B 3/06 2/132
2011/0289650 A1 * 12/2011 Arrona ..... A41B 3/06 2/129

(Continued)

FOREIGN PATENT DOCUMENTS

WO WO-2012162414 A2 * 11/2012 ..... A41B 3/06

*Primary Examiner* — Alissa L Hoey
(74) *Attorney, Agent, or Firm* — Sandra L. Layer

(57) ABSTRACT

A collar support system for supporting a shirt collar in a stylish orientation to improve a wearer's appearance and for retaining the collar in its stylish orientation throughout a day's activities.

7 Claims, 4 Drawing Sheets

(56) References Cited

U.S. PATENT DOCUMENTS

| | | | | |
|---|---|---|---|---|
| 2012/0023640 | A1* | 2/2012 | Gutierrez Garcia | A41B 3/06 2/116 |
| 2012/0223108 | A1* | 9/2012 | Boyd | A61L 9/042 223/86 |
| 2013/0042392 | A1* | 2/2013 | Ostrow | A41B 1/14 2/258 |
| 2013/0269078 | A1* | 10/2013 | Andrade | D06F 59/02 2/69 |
| 2014/0223640 | A1* | 8/2014 | English | A41B 3/06 2/256 |
| 2014/0345031 | A1* | 11/2014 | Reidsema | A41B 3/06 2/132 |
| 2015/0313289 | A1* | 11/2015 | Lester | A41B 3/06 223/2 |
| 2017/0027238 | A1* | 2/2017 | Groth | A41B 3/06 |
| 2017/0311649 | A1* | 11/2017 | Garcia | A41B 3/06 |
| 2018/0036449 | A1* | 2/2018 | Edwards | A61L 9/012 |
| 2019/0116887 | A1* | 4/2019 | Harnisth | A41B 3/08 |
| 2020/0037672 | A1* | 2/2020 | Moczygemba | A41B 3/06 |
| 2020/0221790 | A1* | 7/2020 | Mohammadian-Khezerlou | A41B 3/06 |
| 2020/0397060 | A1* | 12/2020 | O'Neal | A41B 3/06 |

* cited by examiner

FIG. 6
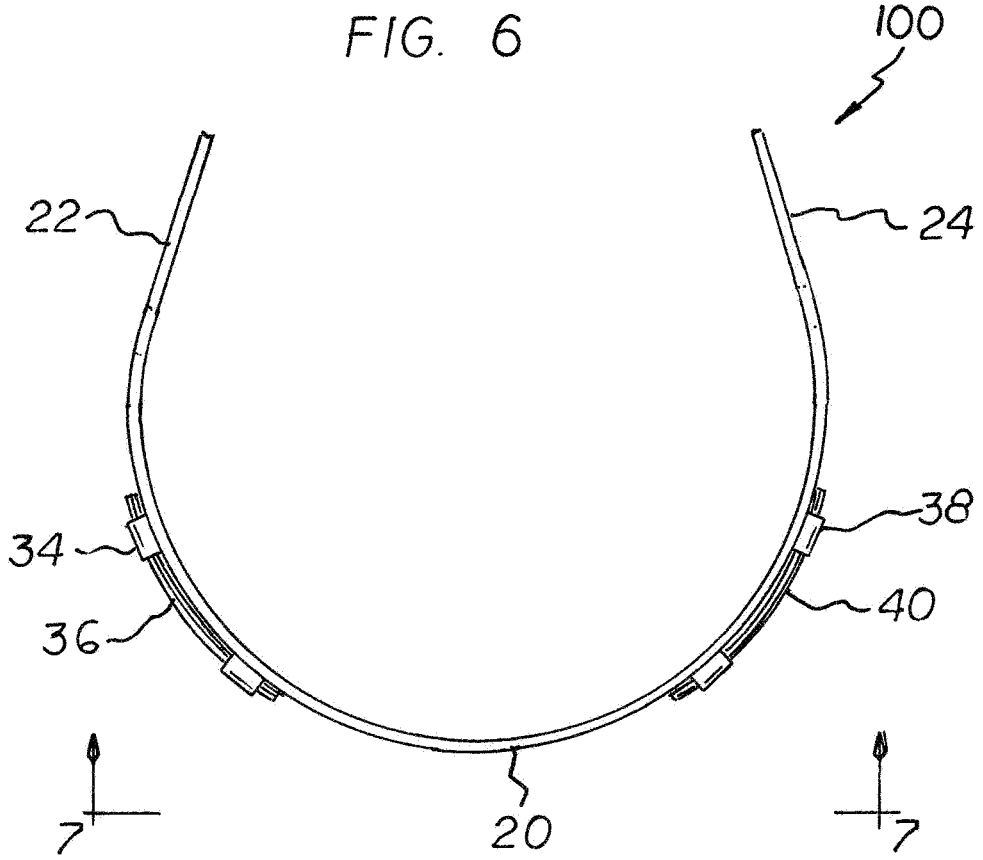
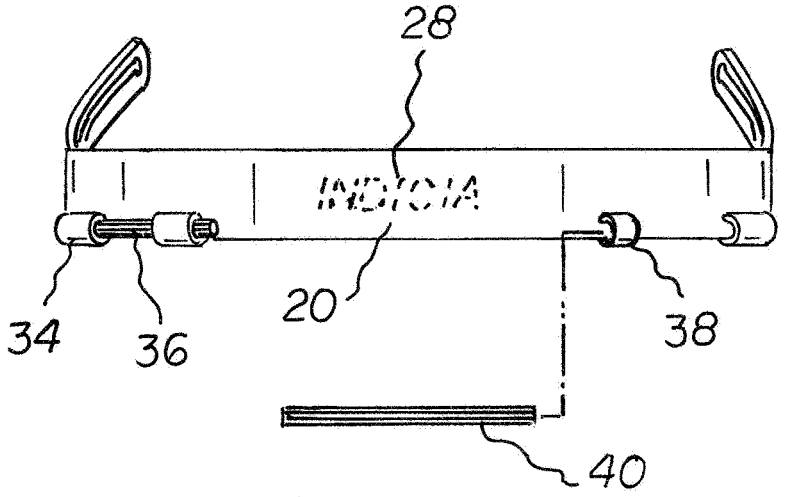
FIG. 7

COLLAR SUPPORT SYSTEM

RELATED APPLICATION

The present patent application claims priority to the corresponding provisional patent application Ser. No. 62/949,077 entitled "COLLAR SUPPORT SYSTEM" filed on Dec. 17, 2019.

BACKGROUND OF THE INVENTION

Field of the Invention

The present invention relates to a collar support system and more particularly pertains to supporting a shirt collar in a stylish orientation to improve a wearer's appearance and for retaining the collar in its stylish orientation throughout a day's activities. The supporting and retaining are done in a safe, eye-appealing, convenient, and economical manner.

Description of the Prior Art

The use of collar supports is known in the prior art. More specifically, collar supports previously devised and utilized for the purpose of supporting shirt collars and improving a wearer's appearance are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a collar support system that allows supporting a shirt collar in a stylish orientation to improve a wearer's appearance and for retaining the collar in its stylish orientation throughout a day's activities. The supporting and retaining are done in a safe, eye-appealing, convenient, and economical manner.

In this respect, the collar support system according to the present invention substantially departs from the conventional concepts and designs of the prior art, and in doing so provides an apparatus primarily developed for the purpose of supporting a shirt collar in a stylish orientation to improve a wearer's appearance and for retaining the collar in its stylish orientation throughout a day's activities. The supporting and retaining are done in a safe, eye-appealing, convenient, and economical manner.

Therefore, it can be appreciated that there exists a continuing need for a new and improved collar support system which can be used for supporting a shirt collar in a stylish orientation to improve a wearer's appearance and for retaining the collar in its stylish orientation throughout a day's activities. The supporting and retaining are done in a safe, eye-appealing, convenient, and economical manner. In this regard, the present invention substantially fulfills this need.

SUMMARY OF THE INVENTION

In view of the foregoing disadvantages inherent in the known types of collar supports now present in the prior art, the present invention provides an improved collar support system. As such, the general purpose of the present invention, which will be described subsequently in greater detail, is to provide anew and improved collar support system and method which has all the advantages of the prior art and none of the disadvantages.

To attain this, for a broad perspective, the present invention essentially comprises a collar support formed with a semi-circular central section and left and right angled sections. The semi-circular central section has left and right side sections and a rear section. The semi-circular central section has upper and lower edges with a height there between. The semi-circular central section has front and rear faces with a thickness there between. The left and right angled sections each having exterior and interior ends with a length there between. The left and right angled sections each have upper and lower edges with a height there between. The left and right angled sections each have front and rear faces with a thickness there between. The left and right angled sections each are angled upwardly from the central section. The left and right side sections have an upper edge and a lower edge, the lower edge with a concave cut-out positionable on the shoulders of a user. A brightly colored section extends downward and along the upper edge of the back portion of the central section to increase visibility when not in use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collar support system which has all of the advantages of the prior art collar supports and none of the disadvantages.

It is another object of the present invention to provide a new and improved collar support system which may be easily and efficiently manufactured and marketed.

It is a further object of the present invention to provide a new and improved collar support system which is of durable and reliable constructions.

An even further object of the present invention is to provide a new and improved collar support system which is susceptible of a low cost of manufacture with regard to both materials and labor, and which accordingly is then susceptible of low prices of sale to the consuming public, thereby making such collar support system economically available to the buying public.

Lastly, it is an object of the present invention to provide a collar support system for supporting a shirt collar in a stylish orientation to improve a wearer's appearance and for retaining the collar in its stylish orientation throughout a day's activities. The supporting and retaining are done in a safe, eye-appealing, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a top plan view of an alternate embodiment of a collar support system showing the scent holders.

FIG. 7 is a rear elevational view of an alternate embodiment taken along line 7-7 of FIG. 6.

The same reference numerals refer to the same parts throughout the various Figures.

DESCRIPTION OF THE PREFERRED EMBODIMENT

Figure 1:
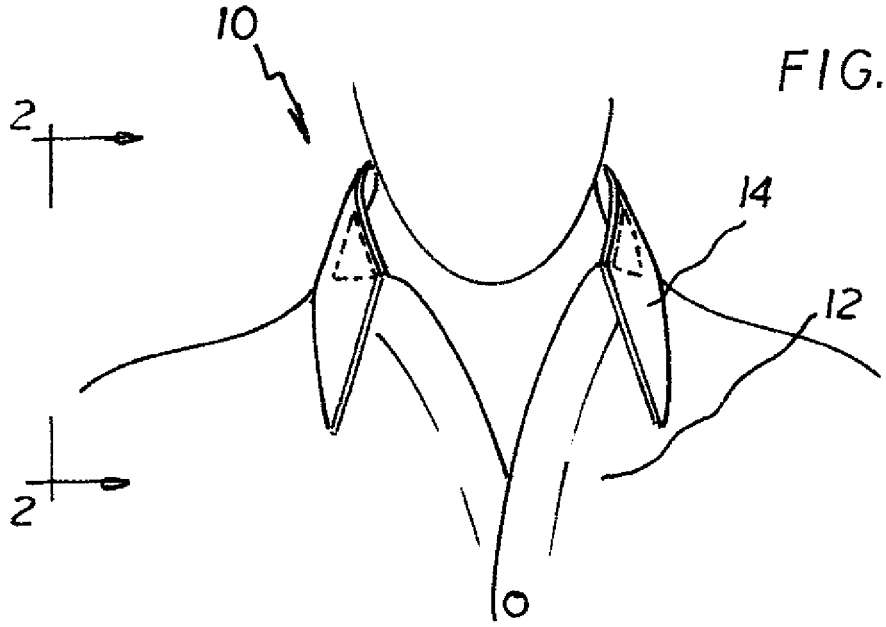
FIG. 1 is a perspective illustration of a collar support system constructed in accordance with the principles of the present invention, the collar support system being worn.
Figure 2:
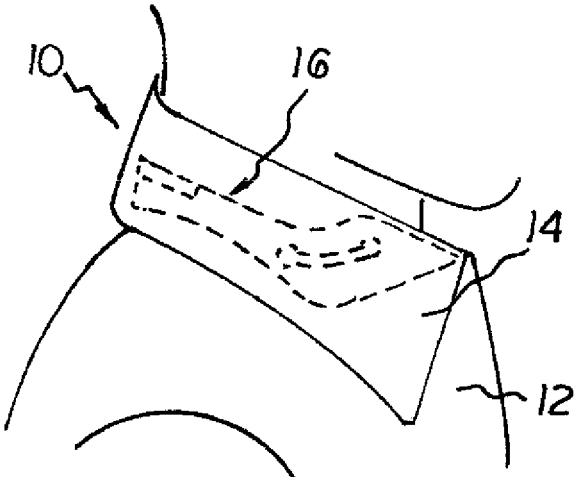
FIG. 2 is a side elevational view taken along line 2-2 of FIG. 1.
Figure 3:
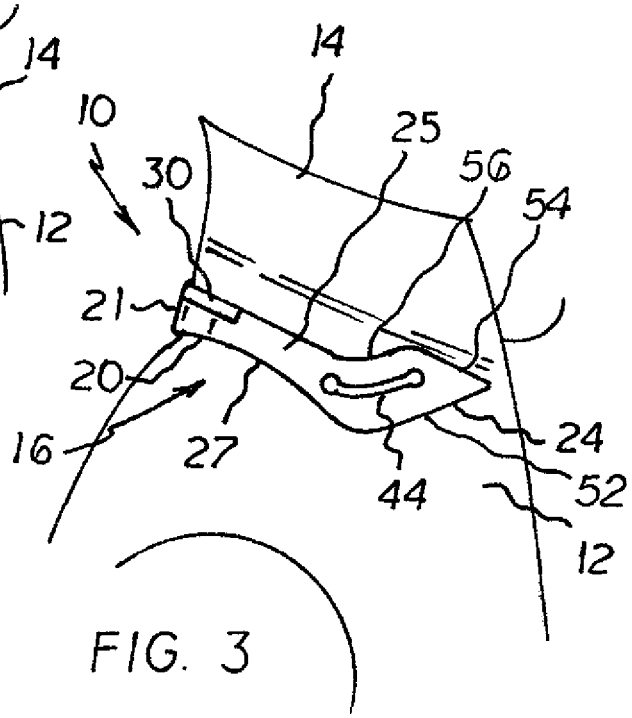
FIG. 3 is a side elevational view similar to FIG. 2 but with the shirt collar raised.
Figure 4:
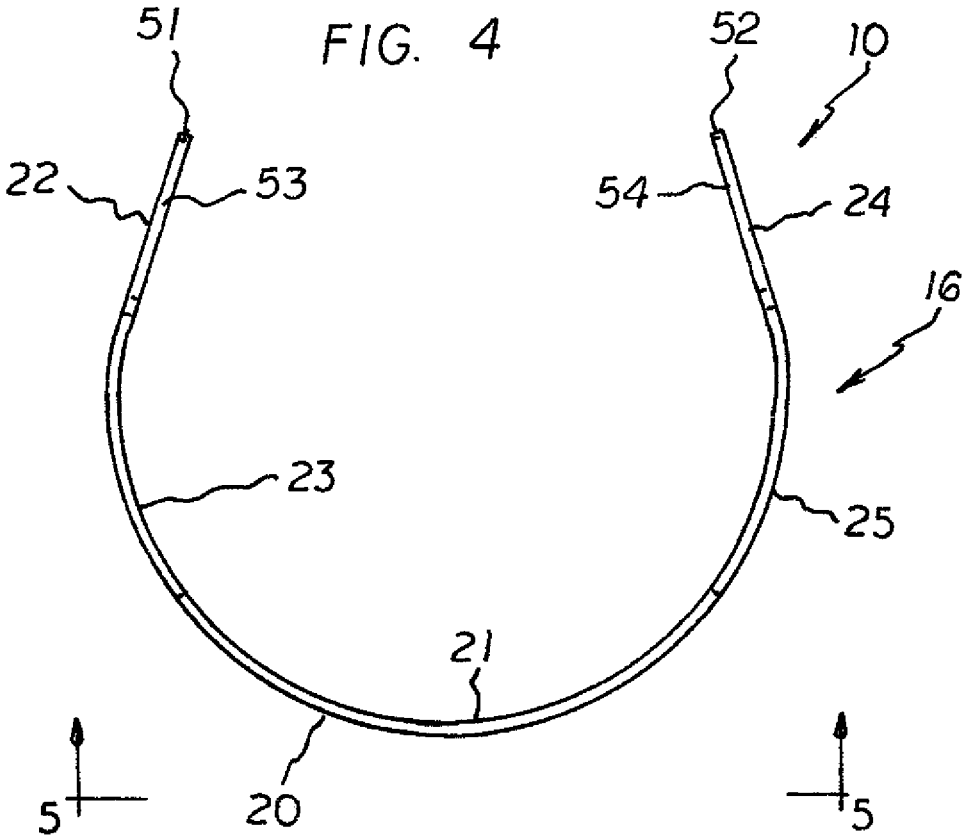
FIG. 4 is a top plan view of the collar support illustrated in the prior Figures.
Figure 5:
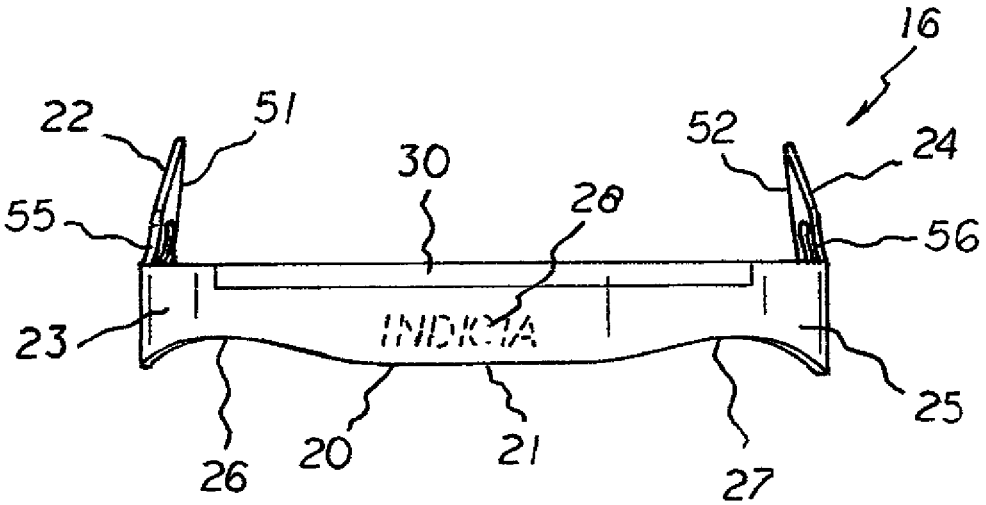
FIG. 5 is a rear elevational view taken along line 5-5 of FIG. 4.

With reference now to the drawings, and in particular to FIG. 1 through 5 thereof, the preferred embodiment of the new and improved collar support system embodying the principles and concepts of the present invention and generally designated by the reference numeral 10 will be described.

The present invention, the collar support system 10 is comprised of a plurality of components. Such components in their broadest context include a central semi-circular section, and left and right angled sections. Such components are individually configured and correlated with respect to each other so as to attain the desired objective.

From a specific perspective, the invention of the present application is a collar support system 10 for a shirt 12 with a collar 14. The shirt and the collar are joined in an inverted V-shaped cross sectional configuration creating a passageway between the shirt and the collar for the receipt of a collar support 16. The system is adapted for holding the collar erect and for improving the appearance of a wearer. The holding of the collar and the improving of the appearance are done in a safe and convenient and economical manner.

The collar support is formed with a semi-circular central section 20, a left angled section 22 and a right angled section 24.

The semi-circular central section has a rearward section 21 and left and right ends with a length there between forming a left side 23 and a right side 25. The left side 23 extending from the rearward section to the left angled section 22. The right side 25 extending from the rearward section to the right angled section 24. The central section 20 has upper and lower edges with a height there between. The central section has a front face and a rear face with a thickness there between. The preferred embodiment has a thickness of 0.12 inches plus or minus 10 percent.

The left angled section 22 has a proximal edge 55 and a distal edge 51 with a length there between. The proximal edge 55 is continuous with and angled upward from the upper edge of the central section. The distal edge 51 is continuous with and angled upward from the lower edge of the central section. The left angled section has an upper supporting edge 53. The upper supporting edge is parallel to the top of the shirt collar when positioned on a wearer. In the preferred embodiment the left angled section has front and rear faces with a thickness of 0.12 inches plus or minus 10 percent there between. In the preferred embodiment the left angled section is angled upwardly from the central section at an angle of between 40 and 50 degrees.

The right angled section 24 has a proximal edge 56 and a distal edge 52 with a length there between. The proximal edge 56 is continuous with and angled upward from the upper edge of the central section. The distal edge 52 is continuous with and angled upward from the lower edge of the central section. The right angled section has an upper supporting edge 54 and a lower edge. The upper supporting edge is parallel to the top of the shirt collar when positioned on a wearer supporting the collar in an upward and open position. In the preferred embodiment the right angled section has front and rear faces with a thickness of 0.12 inches plus or minus 10 percent there between. In the preferred embodiment the right angled section is angled upwardly from the central section at an angle of between 40 and 50 degrees.

The semi-circular central section 20, the left angled section 22 and the right angled section 24 are integrally fabricated of a semi rigid material taken from a class of semi rigid materials including plastics and metals. The semi-rigid material allowing limited flexibility when placing the collar support between the shirt and collar while still providing rigid support of the front edge of the collar when in place, keeping the collar in an open and upward position. The preferred embodiment is formed of a clear plastic. The left and right side sections have an upper edge and a lower edge. A downward curve extends the length of the lower edge of the left side section to the angled section forming a concave cutout 26. A downward curve extends the length of lower edge of the right side section to the angled section forming a concave cut-out 27. The left and right side cutouts positionable on the shoulders of a user when in use.

An additional feature includes a colored section extending downward from the upper edge or colored tape 30 adhesively secured to the upper edge of the central section midway between the left end and the right end to identify the upper edge of the collar support while donning the collar support and to provide visability when not in use.

Decorative and informative indicia 28 is included in the back section of the semi-circular section.

A weight-reducing, decorative slot 44 is formed in both the left angled section and the right angled section respectively.

At least one size-indication hole 48 is formed in the left side section and the right side section respectively. A single hole designates a short collar support, a double hole designates a medium support and a triple hole designates a long a support to accommodate various neck and collar sizes.

Figure 8:
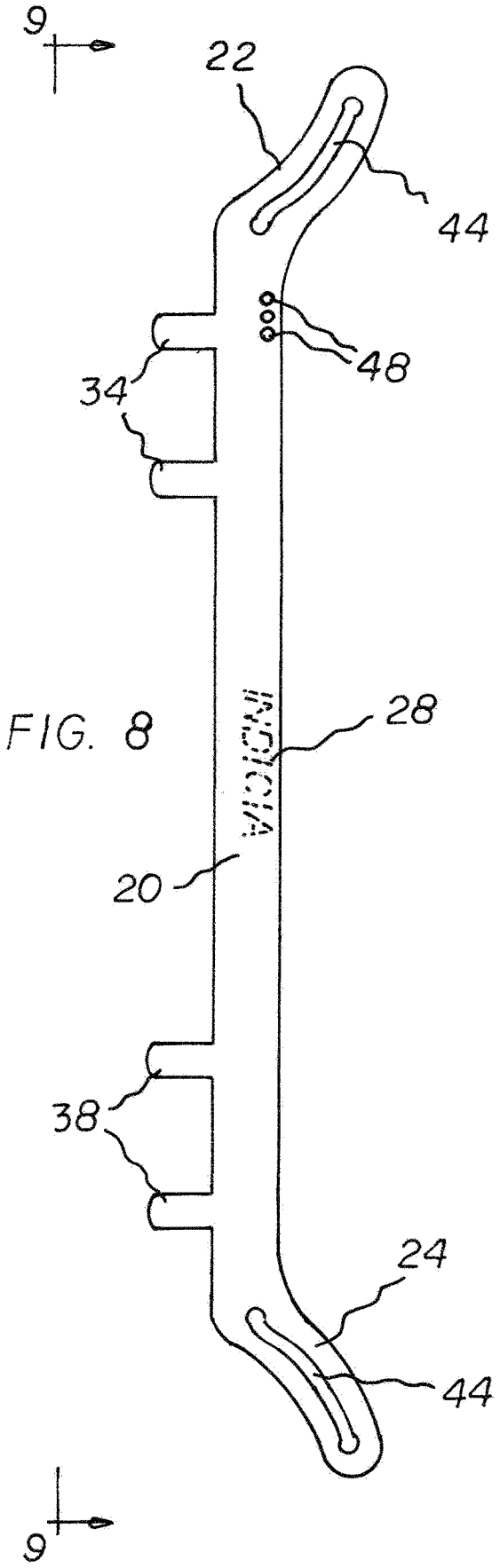
FIG. 8 top plan view similar to FIG. 6 but prior to forming the curves.
Figure 9:
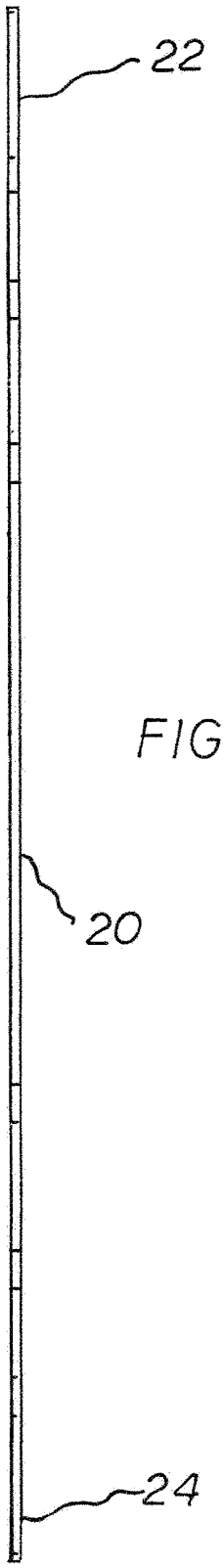
FIG. 9 is a plan view taken along line 9-9 of FIG. 8.

In an alternate embodiment 100, shown in FIGS. 6 through 9, two laterally spaced left tabs 34 extend downwardly from the bottom edge of the collar support adjacent to the right end. The left tabs are curled in a circular configuration with an aroma cylinder 36 supported by the left tabs to generate a pleasant sent about the wearer of the support collar. Two laterally spaced right tabs 38 extend downwardly from the bottom edge of the collar support adjacent to the left end. The right tabs are curled in a circular configuration with an aroma cylinder 40 supported by the right tabs to generate a pleasant scent about the wearer of the support collar.

The collar support system is a Groove Collar, stylish accessory for any collared shirt. The Groove Collar functions as an amazing styling tools for both Men and Women wishing to dress to impress. The Groove Collar features sides that cup up sharply to retain a collar in a stylish high and open format preventing collar droop, unevenness, wrinkling and gapping. The Groove collar is the greatest accessory for fashion shirts and is simple to wear by turning up your collar like a tie and sliding in place. The curved bottom provides comfortable support along the neck and shoulder of the wearer. The different sizes accommodate various neck sizes. The Groove Collar was designed by a dancer and when worn properly can improve posture by discouraging shoulder slumping. The bright marking on the upper edge of the back edge marks the top and makes the clear collar more visible when not being worn. The Groove Collar is lightweight and comfortable to wear.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collar support system for supporting a shirt collar comprising, in combination:

a left angled section and a right angled section;

a semi-circular central section coupling the left angled section and the right angled section;

the semi-circular central section having an upper edge and a lower edge, the semi-circular central section having a rearward section, a right side section and a left side section, the left side section extending from the rearward section to the left angled section, a downward curve extending the length of the lower edge of the left side section to the left angled section forming a concave cut-out configurable to be positioned on the left shoulder of a user when in use, the right side section extending from the rearward section to the right angled section, a downward curve extending the length of the lower edge of the right side section to the right angled section forming a concave cut-out configurable to be positioned on the right shoulder of a user when in use;

the left angled section and the right angled section being angled up from the semi-circular central section;

the left angled section having a left proximal edge and a left distal edge with a length there between, the left proximal edge continuous with and angled upward from the upper edge of the left side section, the left distal edge continuous with and angled upward from the lower edge of the left side section, the left angled section having a left upper supporting edge, the left upper supporting edge connecting the left proximal edge and the left distal edge and laterally spaced above the upper edge of the left side section;

the right angled section having a right proximal edge and a right distal edge with a length there between, the right proximal edge continuous with and angled upward from the upper edge of the right side section, the right distal edge continuous with and angled upward from the lower edge of the right side section, the right angled section having a right upper supporting edge, the right upper supporting edge connecting the right proximal edge and the right distal edge and laterally spaced above the upper edge of the right side section;

the left angled section, the right angled section and the semi-circular central section are integrally fabricated of a semi-rigid plastic;, and the system being positionable beneath an open collar of a shirt, the left upper supporting edge and the right upper supporting edge are parallel to the top of the open collar when positioned beneath the open collar of the shirt for support and style enhancement.

2. The system as set forth in claim 1 and further including a shirt body with a collar and a space between the shirt body and the collar for receiving the system.

3. The system as set forth in claim 1 wherein at least one size indicating hole is formed in the semi-circular central section adjacent to the left angled section.

4. The system as set forth in claim 1 wherein at least one size indicating hole is formed in the semi-circular central section adjacent to the right angled section.

5. The system as set forth in claim 1 wherein the semi-circular central section is further defined as having a colored section extending downward from the upper edge to indicate directional fit and facilitate finding the system if dropped.

6. The system as set forth in claim 1 having two laterally spaced left tabs extending downwardly from the lower edge of the left side section of the semi-circular central section, the left tabs curled in a circular configuration, an aroma cylinder supported by the left tabs, two laterally spaced right tabs extending downwardly from the lower edge of the right side section of semi-circular central section, the right tabs curled in a circular configuration, an aroma cylinder supported by the right tabs.

7. A collar support system for supporting a shirt collar comprising, in combination:

a left angled section and a right angled section;

a semi-circular central section coupling the left angled section and the right angled section;

the system being positionable beneath a collar of a shirt for support and style enhancement;

a shirt body with a collar and a space between the shirt body and the collar for receiving the system;

the semi-circular central section having an upper edge and a lower edge, the semi-circular central section having a rearward section, a right side section and a left side section, the left side section extending from the rearward section to the left angled section, a downward curve extending the length of the lower edge of the left side section to the left angled section forming a concave cut-out configured to be positionable on the left shoulder of a user when in use, the right side section extending from the rearward section to the right angled section, a downward curve extending the length of the lower edge of the right side section to the right angled section forming a concave cut-out configured to be positionable on the right shoulder of a user when in use;

the left angled section having a left proximal edge and a left distal edge with a length there between, the left proximal edge continuous with and angled upward from the upper edge of the left side section, the left distal edge continuous with and angled upward from the lower edge of the left side section, the left angled section having a left upper supporting edge, the left upper supporting edge connecting the left proximal edge and the left distal edge and laterally spaced above the upper edge of the left side section;

the right angled section having a right proximal edge and a right distal edge with a length there between, the right proximal edge continuous with and angled upward from the upper edge of the right side section, the right distal edge continuous with and angled upward from the lower edge of the right side section, the right angled section having a right upper supporting edge, the right upper supporting edge connecting the right proximal edge and the right distal edge and laterally spaced above the upper edge of the right side section;

the left angled section, the right angled section and the semi-circular central section being integrally fabricated of a semi-rigid plastic;

the left upper supporting edge and the right upper supporting edge are parallel to the top of the collar when positioned beneath the open collar of the shirt;

one or more size indicating holes formed in the semi-circular central section adjacent to the left angled section;

weight-reducing, decorative slots formed in both the left angled section and the right angled section respectively; and colored tape affixed to the upper edge of the rearward section to indicate directional fit and facilitate finding the system if dropped.

* * * * *